US008021194B2

(12) United States Patent
Jatou et al.

(10) Patent No.: US 8,021,194 B2
(45) Date of Patent: Sep. 20, 2011

(54) CONTROLLED IMPEDANCE DISPLAY ADAPTER

(75) Inventors: Ross F. Jatou, San Jose, CA (US); Charlie J. Shu, San Ramon, CA (US); Nandan Subraman, Milpitas, CA (US)

(73) Assignee: Nvidia Corporation, Santa Clara, CA (US)

( * ) Notice: Subject to any disclaimer, the term of this patent is extended or adjusted under 35 U.S.C. 154(b) by 0 days.

(21) Appl. No.: 12/005,744

(22) Filed: Dec. 28, 2007

(65) Prior Publication Data

US 2008/0174595 A1 Jul. 24, 2008

Related U.S. Application Data

(62) Division of application No. 11/114,347, filed on Apr. 25, 2005.

(51) Int. Cl.
*H01R 25/00* (2006.01)

(52) U.S. Cl. ..... 439/638

(58) Field of Classification Search ..... 439/607–610, 439/638, 654, 325, 76.1, 623, 505, 67, 607.48, 439/607.01; 345/211
See application file for complete search history.

(56) References Cited

U.S. PATENT DOCUMENTS

| | | | | |
|---|---|---|---|---|
| 3,940,740 | A | 2/1976 | Coontz | |
| 4,541,075 | A | 9/1985 | Dill et al. | |
| 4,773,044 | A | 9/1988 | Sfarti et al. | |
| 4,885,703 | A | 12/1989 | Deering | |
| 4,942,400 | A * | 7/1990 | Tarzaiski et al. | 341/155 |
| 4,951,220 | A | 8/1990 | Ramacher et al. | |
| 4,985,988 | A | 1/1991 | Littlebury | |
| 5,036,473 | A | 7/1991 | Butts et al. | |
| 5,276,893 | A | 1/1994 | Savaria | |
| 5,392,437 | A | 2/1995 | Matter et al. | |
| 5,406,472 | A | 4/1995 | Simmons et al. | |
| 5,448,496 | A | 9/1995 | Butts et al. | |
| 5,513,144 | A | 4/1996 | O'Toole | |
| 5,513,354 | A | 4/1996 | Dwork et al. | |
| 5,567,180 | A * | 10/1996 | Seo | 439/638 |
| 5,578,976 | A | 11/1996 | Yao | |
| 5,630,171 | A | 5/1997 | Chejlava, Jr. et al. | |
| 5,634,107 | A | 5/1997 | Yumoto et al. | |
| 5,638,946 | A | 6/1997 | Zavracky | |
| 5,671,376 | A | 9/1997 | Bucher et al. | |
| 5,694,143 | A | 12/1997 | Fielder et al. | |
| 5,766,979 | A | 6/1998 | Budnaitis | |
| 5,768,178 | A | 6/1998 | McLaury | |

(Continued)

FOREIGN PATENT DOCUMENTS

EP 1681625 7/2006

(Continued)

OTHER PUBLICATIONS

Zimmermann, "OSI Reference Model—The ISO Model of Architecture for Open Systems Interconnection, " IEEE Transactions on Communications, Apr. 1980.

(Continued)

*Primary Examiner* — Edwin A. Leon

(57) ABSTRACT

A display adapter for a digital connector and an analog connector. The display adapter includes a PCB (printed circuit board). A first connector and a second connector are both mounted on the PCB. The first connector and second connectors can be VGA, DVI-I, DVI-D, or HDMI format. The PCB is configured to communicatively couple video signals between the first connector having one format and the second connector having a different format.

18 Claims, 6 Drawing Sheets

U.S. PATENT DOCUMENTS 5,805,833 A 9/1998 Verdun
5,909,595 A 6/1999 Rosenthal et al.
5,913,218 A 6/1999 Carney et al.
5,937,173 A 8/1999 Olarig et al.
5,956,252 A 9/1999 Lau et al.
5,996,996 A 12/1999 Brunelle
5,999,990 A 12/1999 Sharrit et al.
6,003,100 A 12/1999 Lee
6,049,870 A 4/2000 Greaves
6,065,131 A 5/2000 Andrews et al.
6,067,262 A 5/2000 Irrinki et al.
6,069,540 A 5/2000 Berenz et al.
6,072,686 A 6/2000 Yarbrough
6,085,269 A 7/2000 Chan et al.
6,094,116 A 7/2000 Tai et al.
6,219,628 B1 4/2001 Kodosky et al.
6,255,849 B1 7/2001 Mohan
6,307,169 B1 10/2001 Sun et al.
6,323,699 B1 11/2001 Quiet
6,363,285 B1 3/2002 Wey
6,363,295 B1 3/2002 Akram et al.
6,370,603 B1 4/2002 Silverman et al.
6,377,898 B1 4/2002 Steffan et al.
6,389,585 B1 5/2002 Masleid et al.
6,392,431 B1 5/2002 Jones
6,429,288 B1 8/2002 Esswein et al.
6,429,747 B2 8/2002 Franck et al.
6,433,657 B1 8/2002 Chen
6,437,657 B1 8/2002 Jones
6,486,425 B2 11/2002 Seki
6,504,841 B1 1/2003 Larson et al.
6,530,045 B1 3/2003 Cooper et al.
6,535,986 B1 3/2003 Rosno et al.
6,557,070 B1 4/2003 Noel, Jr.
6,598,194 B1 7/2003 Madge et al.
6,629,181 B1 9/2003 Alappat et al.
6,662,133 B2 12/2003 Engel et al.
6,663,432 B2 * 12/2003 Inagawa ..... 439/610
6,700,581 B2 3/2004 Baldwin et al.
6,717,474 B2 4/2004 Chen et al.
6,718,496 B1 4/2004 Fukuhisa et al.
6,734,770 B2 5/2004 Aigner et al.
6,741,258 B1 5/2004 Peck, Jr. et al.
6,747,483 B2 6/2004 To et al.
6,782,587 B2 8/2004 Reilly
6,788,101 B1 9/2004 Rahman
6,794,101 B2 9/2004 Liu et al.
6,806,788 B1 10/2004 Marumoto
6,823,283 B2 11/2004 Steger et al.
6,824,986 B1 11/2004 Finkelman et al.
6,825,847 B1 11/2004 Molnar et al.
6,849,924 B2 2/2005 Allison et al.
6,850,133 B2 2/2005 Ma
6,879,207 B1 4/2005 Nickolls
6,938,176 B1 8/2005 Alben et al.
6,956,579 B1 10/2005 Diard et al.
6,982,718 B2 1/2006 Kilgard et al.
7,020,598 B1 3/2006 Jacobson
7,069,369 B2 6/2006 Chou et al.
7,075,542 B1 7/2006 Leather
7,085,824 B2 8/2006 Forth et al.
7,136,953 B1 11/2006 Bisson et al.
7,174,407 B2 2/2007 Hou et al.
7,174,411 B1 2/2007 Ngai
7,174,412 B2 2/2007 Lin
7,185,135 B1 2/2007 Briggs et al.
7,187,383 B2 3/2007 Kent
7,209,987 B1 4/2007 Schneider et al.
7,248,470 B2 7/2007 Chen et al.
RE039,898 E 10/2007 Nally et al.
7,285,021 B2 10/2007 Bell et al.
7,293,127 B2 11/2007 Castro et al.
7,305,571 B2 12/2007 Cranford, Jr. et al.
7,340,541 B2 3/2008 Castro et al.
7,412,554 B2 8/2008 Danilak
7,424,564 B2 9/2008 Mehta et al.
7,461,195 B1 12/2008 Woodral
7,480,757 B2 1/2009 Atherton et al.
7,480,808 B2 1/2009 Caruk et al.
7,525,986 B2 4/2009 Lee et al.
7,539,809 B2 5/2009 Juenger
2001/0004257 A1 * 6/2001 Nitta et al. ..... 345/211
2002/0005729 A1 1/2002 Leedy
2002/0026623 A1 2/2002 Morooka
2002/0158869 A1 10/2002 Ohba et al.
2002/0186550 A1 12/2002 Hasegawa
2003/0020173 A1 1/2003 Huff et al.
2003/0046472 A1 3/2003 Morrow
2003/0051091 A1 3/2003 Leung et al.
2003/0061409 A1 3/2003 RuDusky
2003/0093506 A1 5/2003 Oliver et al.
2003/0115500 A1 6/2003 Akrout et al.
2003/0164830 A1 9/2003 Kent
2003/0174465 A1 * 9/2003 Isozumi et al. ..... 361/688
2003/0176109 A1 * 9/2003 Fukuchi et al. ..... 439/638
2004/0012597 A1 1/2004 Zatz et al.
2004/0064628 A1 4/2004 Chiu
2004/0085313 A1 5/2004 Moreton et al.
2004/0102187 A1 5/2004 Moller et al.
2004/0183148 A1 9/2004 Blasko, III
2004/0188781 A1 9/2004 Bar
2004/0194988 A1 * 10/2004 Chen ..... 174/35 MS
2004/0227599 A1 11/2004 Shen et al.
2005/0041031 A1 2/2005 Diard
2005/0060601 A1 3/2005 Gomm
2005/0173233 A1 3/2005 Gomm
2005/0088445 A1 4/2005 Gonzalez et al.
2005/0102454 A1 5/2005 McAfee et al.
2005/0104623 A1 5/2005 Guo et al.
2005/0114581 A1 5/2005 Azadet et al.
2005/0227527 A1 10/2005 Diamond et al.
2005/0240703 A1 10/2005 Nguyen et al.
2005/0285863 A1 12/2005 Diamond
2006/0046534 A1 * 3/2006 Birmingham ..... 439/76.1
2006/0055641 A1 3/2006 Robertus et al.
2006/0067440 A1 3/2006 Hsu et al.
2006/0098020 A1 5/2006 Shen et al.
2006/0106911 A1 5/2006 Chapple et al.
2006/0123177 A1 6/2006 Chan et al.
2006/0168377 A1 7/2006 Vasudevan et al.
2006/0221086 A1 10/2006 Diard
2006/0252285 A1 11/2006 Shen
2006/0267981 A1 11/2006 Naoi
2006/0282604 A1 12/2006 Temkine et al.
2007/0038794 A1 2/2007 Purcell et al.
2007/0067535 A1 3/2007 Liu
2007/0088877 A1 4/2007 Chen et al.
2007/0094436 A1 4/2007 Keown et al.
2007/0115271 A1 5/2007 Seo et al.
2007/0115291 A1 5/2007 Chen et al.

FOREIGN PATENT DOCUMENTS

EP 1681632 7/2006
EP 1691271 8/2006
GB 2422928 8/2006
JP 2006195821 7/2006
JP 2004280237 10/2007
TW 093127712 7/2005
WO 2005029329 3/2005

OTHER PUBLICATIONS

Richard Shoup, "Superpaint: An Early Frame Buffer Graphics System," IEEE Annals of the History of Computing, copyright 2001.
Kuroda et al., "Multimedia Processors," Proceedings of the IEEE, Jun. 1998.
PCI Express Card Electromechanical Specification Rev. 1.1, 2005, p. 87.
Welch, D. "Building Self-Reconfiguring Distributed Systems Using Compensating Reconfiguration", Proceedings Fourth International Journal Conference on Configurable Distributed Systems, May 4-5, 1998, pp. 18-25.
Eckert, et al; Functional Component Coordinated Reconfiguration System and Method; U.S. Appl. No. 11/454,313, filed Jun. 16, 2006.
Diamond, A Semiconductor Die Micro Electro-Mechanical Switch Management System; U.S. Appl. No. 10/942,209, filed Sep. 15, 2004.

Diamond, et al; A System and Method for Remotely Configuring Semiconductor Functional Circuits; U.S. Appl. No. 10/740,779, filed Dec. 18, 2003.
Van Dyke, et al; A System and Method for Increasing Die Yield; U.S. Appl. No. 10/740,723, filed Dec. 18, 2003.
Diamond, et al; A System and Method for Configuring Semiconductor Functional Circuits; U.S. Appl. No. 10/740,722, filed Dec. 18, 2003.
Van Dyke, et al; An Integrated Circuit Configuration System and Method; U.S. Appl. No. 10/740,721, filed Dec. 18, 2003.
Diamond; Micro Electro Mechanical Switch System and Method for Testing and Configuring Semiconductor Functional Circuits; U.S. Appl. No. 10/942,169, filed Sep. 15, 2004.
International Search Report. PCT/US2004/030127. Mail Date Jun. 30, 2005.
PCT International Preliminary Report on Patentability. PCT/US2004/030127. International Filing Date Sep. 13, 2004. Applicant: Nvidia Corporation. Date of Issuance of this Report: Mar. 16, 2006.
European Patent Office E-Space Family List for: WO 2005/29329 (PCT/US 2004/030127).
Won-ok Kwon et al., "PCI Express multi-lane de-skew logic design using embedded SERDES FPGA," ylh International Conference on Solid-State and Integrated Circuits Technology, Oct. 2004, IEEE, vol. 3, pp. 2035-2038.
Qiang Wu Jiamou Xu Xuwen Li Kebin Jia, "The Research and Implementation of Interfacing Based on PCI Express", Aug. 2009, IEEE, The Ninth International Conference on Electronic Measurement and Instruments, pp. 116-121.
Kim et al., "A Dual PFD Phase Rotating Multi-Phase PLL for 5Gbps PCI Express Gen2 Multi-Lane Serial Link Receiver in 0.13urn CMOS," Oct. 2007, IEEE Symposium on VLSI Circuits, IEEE, pp. 234-235.
Davis, Leroy, "PCI-Express 8x Connector Pin Out", Jul. 12, 2008, retrieved from the Internet on Mar. 23, 2009 at http://www.interfacebus.comIDesign_PCI_Express_8x_PinOut.html.
Shimpi, Anand Lal, "NVIDIA SLI Performance Preview with MSI's nForce4 SLI Motherboard", Oct. 29, 2004, Anandtech.com, retrieved from the Internet on Dec. 4, 2007 at http://www.anandtech.com/printarticle.aspx?i=2258.
Altavilla, Dave, "NVIDIA SLI & ASUS A8N-SLI Deluxe Performance Showcase", Dec. 8, 2004. Hothardware.com. retrieved from the Internet on Dec. 4, 2007 at http://hothardware.com/printarticle.aspx?articleid=612.
Bell, Brandon, "nForce4 SLI Performance Preview", Nov. 23, 2004, FiringSquad.com. retrieved from the Internet on Dec. 4, 2007 at hUp:/lwww.firingsquad.comlhardware/nvidia_nforce_4_sli/page3.asp.
Restriction/Election dated Oct. 9, 2007; U.S. Appl. No. 11/114,347.
Office Action dated Jul. 9, 2008; U.S. Appl. No. 11/114,347.
Final Office Action dated Dec. 24, 2008; U. S. Appl. No. 11/114,347.
Office Action dated May 13, 2009; U.S. Appl. No. 11/114,347.
Final Office Action dated Oct. 5, 2009; U.S. Appl. No. 11/114,347.
Office Action dated Feb. 5, 2010; U.S. Appl. No. 11/114,347.
Notice of Allowance dated Jul. 22, 2010; U.S. Appl. No. 11/114,347.
Notice of Allowance dated Nov. 1, 2010; U.S. Appl. No. 11/114,347.
Notice of Allowance Dated Feb. 7, 2011, U.S. Appl. No. 11/114,347.

* cited by examiner

CONTROLLED IMPEDANCE DISPLAY ADAPTER

This Application is a Divisional of U.S. patent application Ser. No. 11/114,347, filed Apr. 25, 2005, entitled "A CONTROLLED IMPEDANCE DISPLAY ADAPTER" to Ross Jatou, et al., which is hereby incorporated herein in its entirety.

FIELD OF THE INVENTION

The present invention is generally related to high performance display interconnects for computer systems.

BACKGROUND OF THE INVENTION

Modern computer systems feature powerful digital processor integrated circuit devices. The processors are used to execute software instructions that implement complex functions, such as, for example, real-time 3-D graphics applications, photo-retouching and photo editing, data visualization, and the like. The performance of many these graphics-reliant applications is directly benefited by more powerful graphics processors which are capable of accurately displaying large color depths (e.g., 32 bits, etc.), high resolutions (e.g., 1900×1200, 2048×1536 etc.), and are thus able to more clearly present visualized information and data to the user. Computer systems configured for such applications are typically equipped with high-quality, high-resolution displays (e.g., high-resolution CRTs, large high-resolution LCDs, etc.). Video quality generated by the computer system's graphics subsystem and display becomes a primary factor determining the computer system's suitability.

The graphics subsystem of a computer system typically comprises those electronic components that generate the video signal sent through a cable to a display. In modern computers, the graphics subsystem comprises a graphics processor unit (GPU) that is usually mounted on the computer's motherboard or on an expansion board (e.g., discrete graphics card) plugged into the motherboard. The GPU is electrically coupled to a video connector which is in turn used to couple signals from the GPU to the display. In those cases where the GPU is mounted directly on the motherboard, the connector is also mounted on the motherboard. In those cases where the adapter is a discrete add-in graphics card, the connector is mounted on the graphics card.

The connector for coupling the computer system to the display is typically a VGA type connector or a DVI type connector. The vast majority of the connectors produced in the past have traditionally been VGA (Video Graphics Array) type connectors. VGA connectors refer to the original analog graphics physical interconnect standard introduced with the industry standard IBM PS/2 series. A majority of displays available in the marketplace are compatible with VGA type connectors. More recently, an increasing number of high-quality displays are compatible with DVI (Digital Visual Interface) type connectors. DVI refers to a digital interface standard created by the Digital Display Working Group (DDWG) to convert analog signals into digital signals to accommodate both analog and digital monitors. Generally, digital DVI signals are capable of providing higher fidelity, higher quality images than the analog VGA signals.

Digital DVI was specifically configured to maximize the visual quality of flat panel LCD monitors and to realize the performance potential of high-end graphics cards. DVI is becoming increasingly popular with video card manufacturers, and many recent graphics cards available in the marketplace now include both a VGA and a DVI output port. In addition to being used as the new computer interface, DVI is also becoming the digital interconnect method of choice for HDTV, EDTV, Plasma Display, and other ultra-high-end video displays for TV, movies, and DVDs. Likewise, even a few of the top-end DVD players are now featuring DVI outputs.

A problem exists however with respect to the fact that the great majority of the displays existing in the installed base (e.g., the displays that have been purchased within the past 10 years and are still in use) are not compatible with digital DVI. There are three types of DVI connections: DVI-D (Digital); DVI-A (Analog); and DVI-I (Integrated Digital/Analog). The DVI-D format is used for direct digital connections between source video (namely, graphics cards) and digital LCDs (or rare CRT) monitors. This provides a faster, higher-quality image than with analog VGA, due to the nature of the digital format. The DVI-A format is used to carry a DVI signal to an analog display, such as a CRT monitor or an HDTV. Although some signal quality is lost from the digital to analog conversion, it still transmits a higher quality picture than standard VGA. The DVI-I format is an integrated cable which is capable of transmitting either a digital-to-digital signal or an analog-to-analog signal. The DVI-I connectors and cables can support both analog displays and digital displays, and has thus become a preferred connector. But the great majority of the displays in the installed base cannot natively accept a DVI-I cable.

One prior art solution to this problem involved the development of DVI-I to VGA adapter components that are configured to convert the analog signals from the DVI-I format to the VGA format. These adapters often come in the form of a "dongle" or component that hangs off on the back of the computer system and is connected in-series between the graphics card of the computer system and the analog display. One connector of the dongle is designed to mate with a DVI-I connector and the other end of the dongle is designed to mate with a VGA connector. This enables a digital output computer to use a VGA display.

This solution is less than satisfactory due to the fact that the prior art dongles require intricate internal wiring and soldering in order to physically couple the signal lines for the analog DVI-I signal to the VGA signal. The internal wiring requires precise control with respect to wire length and wire impedance in order to maintain high signal quality for high-quality displays. The internal wiring requires proper EMI shielding to prevent EMI (electromagnetic interference) problems. These requirements make proper quality control of the often labor-intensive manufacturing processes for the prior art type dongle difficult. Low-cost manufacturing techniques often yield sub-par components. High-quality components can only be obtained (if at all) at a high cost. Thus a need exists for a high-quality, readily manufacturable conversion device compatible VGA connectors and with more advanced digital connections such as DVI-I.

SUMMARY OF THE INVENTION

Embodiments of the present invention comprise an efficient device to adapter signals and interconnect a DVI-I connector, DVI-D connector HDMI connector and VGA connector. Embodiments of the present invention eliminate the need for any intricate internal wiring and soldering of signal lines, and provides precise control over signal trace length and impedance. Embodiments of the present invention maintain high-quality signal characteristics for high-quality displays and provides greatly improved EMI shielding.

In one embodiment, the present invention is implemented as a dual shielded DVI-I to VGA display adapter. The display adapter includes an EMI shielded PCB (printed circuit board) and an EMI shielded device case enclosing the PCB. A VGA connector is edge mounted on the PCB (e.g., on one end) and a DVI-I connector is edge mounted on the PCB (e.g., on the other end). The PCB includes a plurality of signal traces for communicatively coupling analog signals (e.g., the analog VGA display signals) between the VGA connector and the DVI-I connector.

In one embodiment, the display adapter has a first connector and a second connector mounted on the PCB, wherein the first and second connectors are VGA, DVI-I, DVI-D, or HDMI format. The PCB is configured to communicatively couple video signals between the first connector having one format and the second connector having a different format (e.g., DVI-I-to-HDMI, DVI-D-to-HDMI, etc.).

The dual shielding of the device case enclosure and the PCB greatly improves EMI shielding of the device in comparison to the prior art. Additionally, the use of PCB manufacturing techniques enable precise quality control of the manufacturing processes and leverages the widespread PCB manufacturing infrastructure to reduce costs.

BRIEF DESCRIPTION OF THE DRAWINGS

The present invention is illustrated by way of example, and not by way of limitation, in the figures of the accompanying drawings and in which like reference numerals refer to similar elements.

DETAILED DESCRIPTION OF THE INVENTION

Reference will now be made in detail to the preferred embodiments of the present invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of embodiments of the present invention, numerous specific details are set forth in order to provide a thorough understanding of the present invention. However, it will be recognized by one of ordinary skill in the art that the present invention may be practiced without these specific details. In other instances, well-known methods, procedures, components, and circuits have not been described in detail as not to unnecessarily obscure aspects of the embodiments of the present invention.

Figure 1:
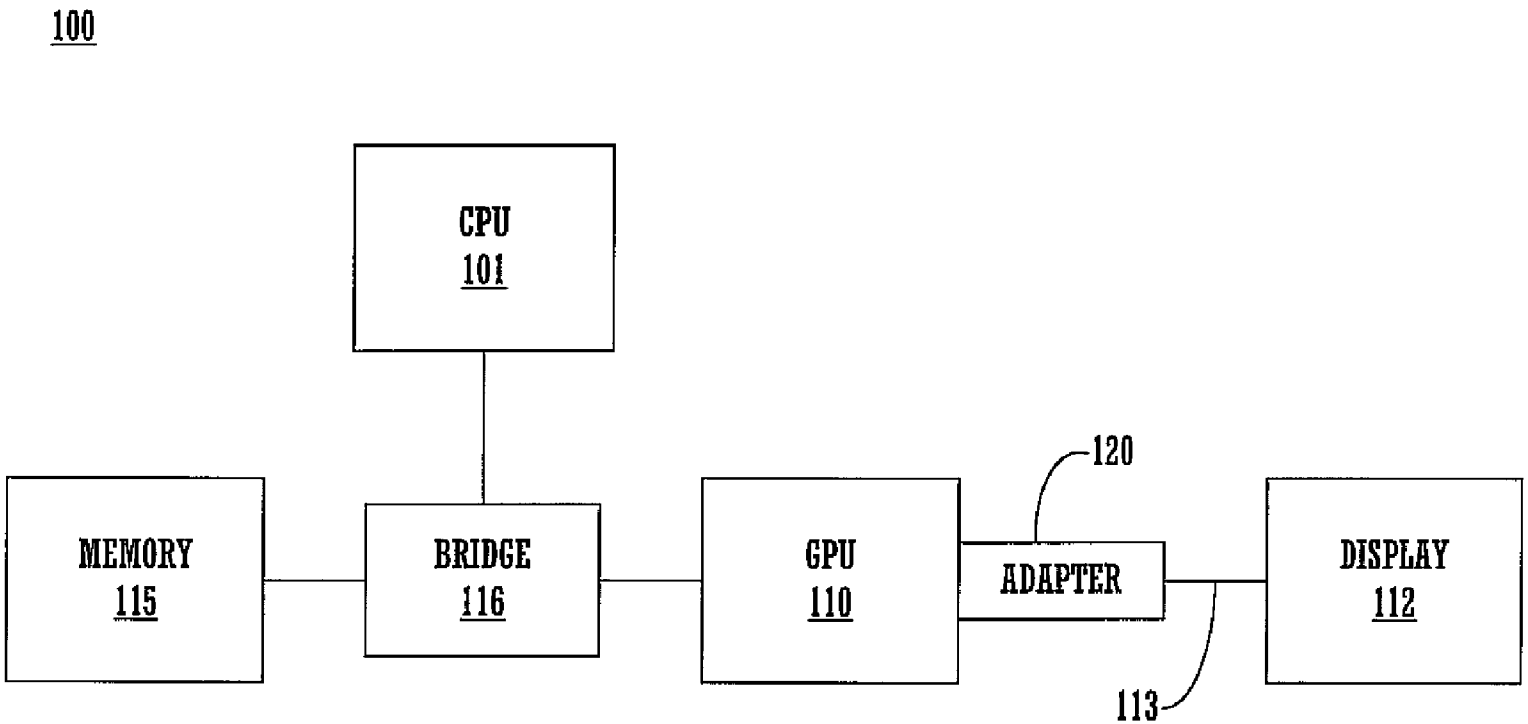
FIG. 1 shows a computer system in accordance with one embodiment of the present invention.

FIG. 1 shows a computer system 100 in accordance with one embodiment of the present invention. In general, computer system 100 comprises at least one CPU 101 coupled to a system memory 115 and a graphics processor unit (GPU) 110 via one or more busses as shown. Access to the system memory 115 is implemented by a memory controller/bridge 116. The GPU 110 is coupled to a display 112. System 100 can be implemented as, for example, a desktop computer system or server computer system, having a powerful general-purpose CPU 101 coupled to a dedicated graphics rendering GPU 110. In such an embodiment, components would be included that are designed to add peripheral buses, specialized graphics memory and system memory, IO devices, and the like.

It should be appreciated that although the GPU 110 is depicted in FIG. 1 as a discrete component, the GPU 110 can be implemented as a discrete graphics card designed to couple to the computer system via a graphics port (e.g., AGP port, PCI Express port, SATA port, or the like), as a discrete integrated circuit die (e.g., mounted directly on the motherboard), or as an integrated GPU included within the integrated circuit die of a computer system chipset component (e.g., integrated within a bridge chip). Additionally, a local graphics memory can be included for the GPU 110 (e.g., for high bandwidth graphics data storage). It should be noted that although the memory controller/bridge 116 is depicted as a discrete component, the memory controller/bridge 116 can be implemented as an integrated memory controller within a different component (e.g., within the CPU 101, GPU 110, etc.) of the computer system 100. Similarly, system 100 can be implemented as a set-top video game console device such as, for example, the Xbox®, available from Microsoft Corporation of Redmond, Wash.

Referring still to FIG. 1, a display adapter 120 is shown coupled to the GPU 110 and coupled to the display 112. Embodiments of the present invention comprise an efficient display adapter device (e.g., display adapter 120) that functions by interconnecting a DVI-I based connection and the VGA based connection. For example, as depicted in FIG. 1, the display adapter 120 can interconnect a DVI-I connector of the GPU 110 (e.g., AGP based or SATA based add-in GPU card) with a VGA cable 113 of the display 112 (e.g., a high-quality CRT display).

Figure 2:
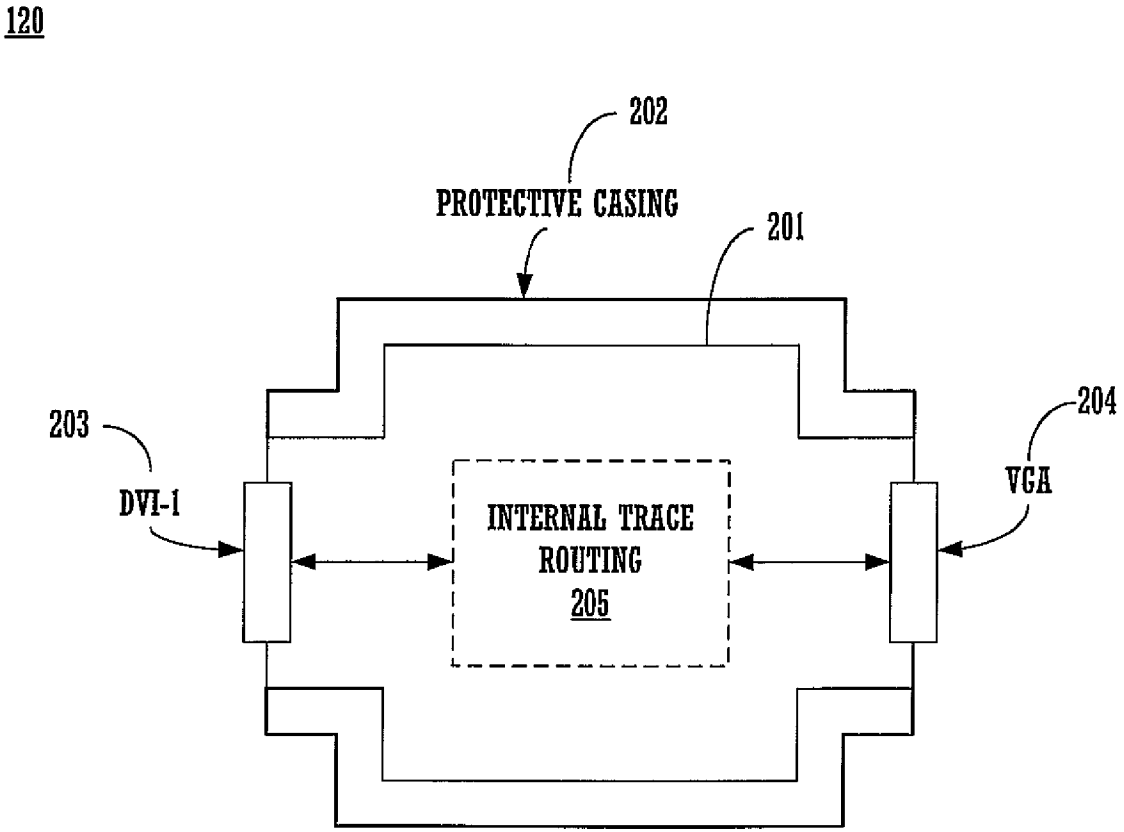
FIG. 2 shows a diagram of the internal components of a display adapter in accordance with one embodiment of the present invention.

FIG. 2 shows a diagram of the internal components of a display adapter 120 in accordance with one embodiment of the present invention. As depicted in FIG. 2, the display adapter 120 includes an internal PCB 201 (printed circuit board) within a protective device enclosure/casing 202. A DVI-I connector 203 is edge mounted on the PCB 201 on one side and a VGA connector 204 is edge mounted on the other side of the PCB 201.

In one embodiment, the display adapter 120 functions by transferring analog display signals between the analog portion of the DVI-I connector 203 and the VGA connector 204. The individual signal traces comprising the analog portion of the display signals conveyed by the DVI-I connector 203 are coupled to internal traces 205 of the PCB 201. These traces 205 convey the analog display signals to the VGA connector 204 where they are coupled to the pins/sockets comprising the VGA connector 204.

In one embodiment, the display adapter 120 functions by transferring digital display signals between the digital portion of the DVI-I connector 203 to an HDMI connector (e.g., the connector 204). HDMI (High-definition multimedia interface) is a specification that defines data transfer protocols, tables, connectors, and the like for the transfer of high bandwidth digital multimedia signals between different devices. In such an embodiment, the connector 203 would be an HDMI connector as opposed to a VGA connector. The display adapter 121 would thus function as a DVI-I-to-HDMI adapter. Depending upon the specific application requirements, video signals can be transferred between a DVI-I-to-HDMI or HDMI-to-DVI-I as required. It should be noted that since HDMI is a digital standard, the display adapter 121 can be configured to adapt HDMI to other types of DVI connectors (e.g., DVI-D, etc.).

It should be noted that in one embodiment, the display adapter 120 can incorporate analog-to-digital and digital to analog circuitry for converting analog signals into digital signals. In such an embodiment, analog VGA signals can be translated into digital signals and vice versa. This would allow the adapting of analog VGA signals to and from a number of different types of digital signals (e.g., VGA to DVI-I, VGA to DVD-D, VGA to HDMI, etc.).

PCB manufacturing techniques are used to implement the internal trace routing 205 of the printed circuit board 201. PCB manufacturing techniques readily enable precise control of the length of each of the individual traces and precise control over their impedance. PCB manufacturing techniques also readily enable the fabrication of precise and uniform solder connections between the connectors 203-204 and the PCB 201. These attributes greatly improve the signal quality deliverable by the display adapter 120 in comparison to the prior art. In this manner, the display adapter 120 embodiment of the present invention completely eliminates any need for tedious, error-prone, manual internal wiring, which was prevalent in prior art manufacturing techniques.

Additionally, the display adapter 120 uses PCB manufacturing techniques to implement EMI shielding for the traces 205 and the connectors 203-204. The PCB shielding can reduce or eliminate the need for conventional copper wrapping based EMI shielding used in prior art type dongle devices.

It should be noted that the display adapter 120 embodiment can be implemented as a dual shielded display adapter. The display adapter 120 has a first layer of shielded by the fact that the PCB 201 includes one or more layers of EMI shielding material (e.g., copper) to shielded its internal trace routing 205. In addition, the display adapter 120 can include a second layer of EMI shielding as implemented by the device case 202 enclosing the PCB 201 (e.g., whereby the device case 202 incorporates copper sheathing, etc.). Such dual shielding provides a greatly reduced EMI emission (e.g., −3 dB to −9 dB) in comparison to prior art dongle type devices.

Figure 3:
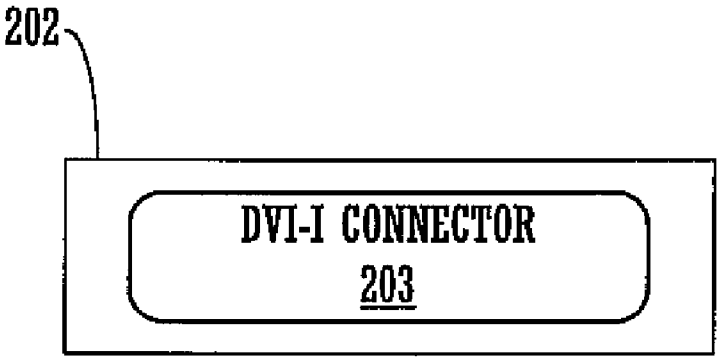
FIG. 3 shows a diagram depicting a DVI-I connector of a display adapter in accordance with one embodiment of the present invention.
Figure 4:
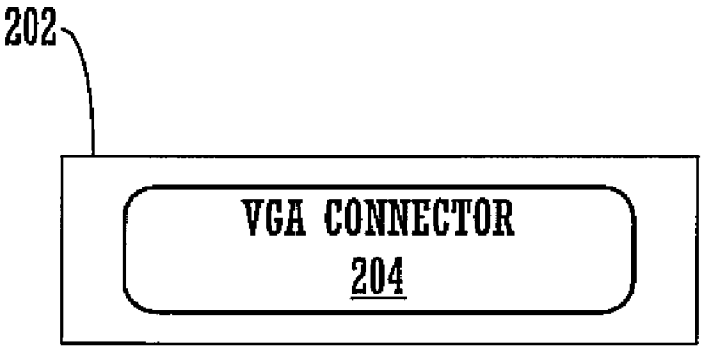
FIG. 4 shows a diagram depicting a VGA connector of a display adapter in accordance with one embodiment of the present invention.

FIG. 3 shows a diagram depicting the DVI-I connector 203 and FIG. 4 shows a diagram depicting the VGA connector 204 of the display adapter 120. The DVI-I connector 203 and/or the VGA connector 204 can be configured to mate directly with the corresponding connectors on a graphics card or a display. Accordingly, depending upon the requirements of a given implementation, the connectors 203-204 can be male or female.

Figure 5:
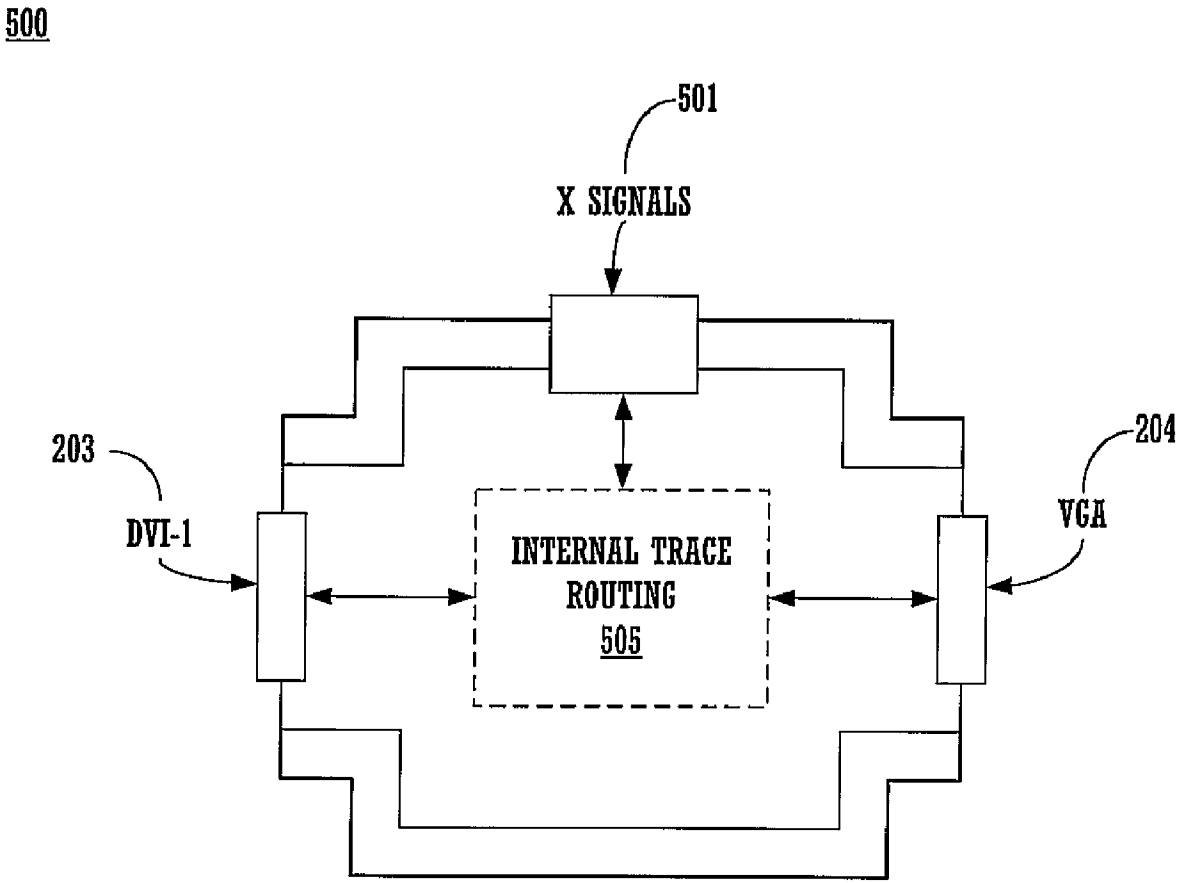
FIG. 5 shows a diagram depicting a three connector display adapter in accordance with one embodiment of the present invention.

FIG. 5 shows a diagram depicting a display adapter 500 in accordance with one embodiment of the present invention. As depicted in FIG. 5, the display adapter 500 includes a third connector 501 in addition to the DVI-I connector 203 and the VGA connector 204.

In the display adapter 500 embodiment, the third connector 501 allows access to additional signals of the DVI-I connector 203 which are not required by the analog VGA signal conveyed to the VGA connector 204. Access to these additional signals is provided by the internal trace routing 505. For example, the unused digital signals of the connector 203 can be routed to the third connector 501, thereby providing external access to those signals by external devices. Such signals can be used to access added functionality implemented on, for example, the GPU card (e.g., GPU 110). The precise manufacturing control afforded by PCB manufacturing techniques (e.g., multilayer PCBs, etc.) enables these unused signals to be connected to the third connector 501 without disturbing the VGA signals.

Similarly, implementing the display adapter 500 on a PCB allows the incorporation of additional circuitry for additional functionality (e.g., indicator LEDs, speakers, etc.) that can be used to indicate different status information to the user, such as indicating when the display is active, or the like. Additional circuitry can be incorporated for filtering to further improve the analog VGA signal or reduce its harmonic content. Another example would be including additional circuitry to protect against ESD (electrostatic discharge) and/or lightning.

It should be noted that the ability to provide multiple edge mounted connectors on the internal PCB allows a display adapter in accordance with embodiments of the present invention to provide multiple configurations of controlled impedance dual display outputs. Such display adapter configurations can include, for example, a DVI-I to a first DVI-D connector and a second VGA connector, a DVI-I to a first VGA connector and a second VGA connector, and the like.

Figure 6:
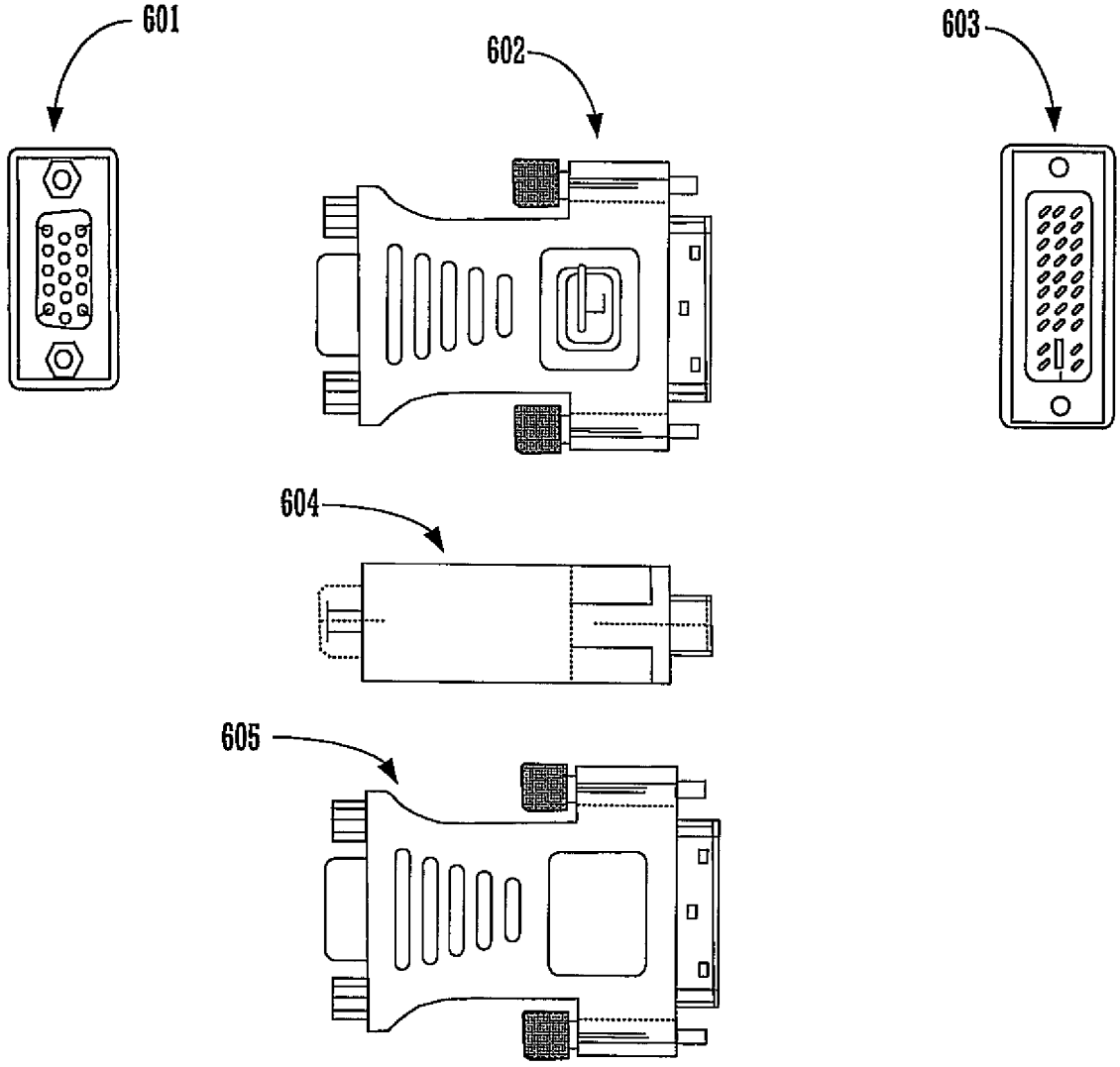
FIG. 6 shows a plurality of views from different angles of a display adapter in accordance with one embodiment of the present invention.

FIG. 6 shows a plurality of views 601-605 from different angles of a display adapter in accordance with one embodiment of the present invention. View 601 shows the VGA connector end of the display adapter. View 603 shows the DVI-I end of the display adapter. View 602 shows a top view of the display adapter. View 604 shows a side view of the display adapter. View 605 shows a bottom view of the display adapter.

The foregoing descriptions of specific embodiments of the present invention have been presented for purposes of illustration and description. They are not intended to be exhaustive or to limit the invention to the precise forms disclosed, and many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A display adapter, comprising:

a PCB (printed circuit board);

a VGA (video graphics array) connector mounted on the PCB comprising at least one layer of copper for EMI (electromagnetic interference) shielding; and a DVI-I (digital visual interface-integrated) connector mounted on the PCB comprising at least one layer of copper for EMI shielding, wherein a plurality of internal traces of the PCB communicatively couples analog signals between the VGA connector and the DVI-I connector, the plurality of internal traces comprising at least one layer of copper for EMI shielding.

2. The display adapter of claim 1, further comprising: a third connector mounted on the PCB for connectivity with a plurality of non-VGA signals of the DVI-I connector.

3. The display adapter of claim 1, further comprising a device case enclosing the PCB.

4. The display adapter of claim 3, wherein the device case comprises copper sheathing for EMI shielding.

5. The display adapter of claim 3, wherein the device case comprises a polycarbonate material.

6. The display adapter of claim 3, wherein the display adapter attaches to a DVI-I connector of a GPU (graphics processor unit) card.

7. A display adapter, comprising:

a PCB (printed circuit board);

a device case enclosing the PCB comprising copper sheathing for EMI (electromagnetic interference) shielding;

a first connector mounted on the PCB comprising at least one layer of copper for EMI shielding;

a second connector mounted on the PCB comprising at least one layer of copper for EMI shielding;

a third connector mounted on the PCB; and a plurality of traces within the PCB to couple analog signals between the first connector and the second connector, and to couple signals from at least one of the first and second connectors to the third connector, wherein the plurality of traces comprise at least one layer of copper for EMI shielding.

8. The display adapter of claim 7, wherein the display adapter can accept an attachment to a DVI-I (digital visual interface-integrated) connector of a GPU (graphics processor unit) card.

9. The display adapter of claim 7, wherein the display adapter can accept an attachment to a VGA (video graphics array) connector of a GPU (graphics processor unit) card.

10. The display adapter of claim 7, wherein the third connector is a HDMI (high-definition multimedia interface) connector, a DVI-D (digital visual interface-digital) connector or a DVI-I connector.

11. The display adapter of claim 7, wherein the third connector can accept an LED (light-emitting diode) to indicate activity of a plurality of signals on the PCB.

12. The display adapter of claim 7, wherein the device case comprises a polycarbonate material.

13. A display adapter, comprising:

a PCB (printed circuit board);

a device case enclosing the PCB;

a VGA (video graphics array) connector mounted on the PCB comprising at least one layer of copper for EMI (electromagnetic interference) shielding;

a DVI-I (digital visual interface-integrated) connector mounted on the PCB comprising at least one layer of copper for EMI shielding;

an auxiliary connector mounted on the PCB; and a plurality of traces within the PCB for communicatively coupling analog signals between the DVI-I connector and the VGA connector, and for communicatively coupling digital signals from the DVI-I connector to the auxiliary connector, wherein the plurality of traces comprise at least one layer of copper for EMI shielding.

14. The display adapter of claim 13 wherein the auxiliary connector is a HDMI (high-definition multimedia interface) connector, a DVI-D (digital visual interface-digital) connector or a DVI-I connector.

15. The display adapter of claim 13 wherein the display adapter is adapted to attach to a DVI-I connector of a GPU (graphics processor unit) card.

16. The display adapter of claim 13 wherein the digital connector can accept an LED (light-emitting diode) to indicate activity of a plurality of signals on the PCB.

17. The display adapter of claim 13 wherein the device case comprises copper sheathing for EMI shielding.

18. The display adapter of claim 13 wherein the device case comprises a polycarbonate material.

* * * * *